US012326312B1

(12) United States Patent
Chen

(10) Patent No.: US 12,326,312 B1
(45) Date of Patent: Jun. 10, 2025

(54) BULLPUP CONVERSION KIT AND GUN INCLUDING THE SAME

(71) Applicant: Wei-Min Chen, Taichung (TW)

(72) Inventor: Wei-Min Chen, Taichung (TW)

( * ) Notice: Subject to any disclaimer, the term of this patent is extended or adjusted under 35 U.S.C. 154(b) by 0 days.

(21) Appl. No.: 18/673,556

(22) Filed: May 24, 2024

(51) Int. Cl.
*F41A 3/66* (2006.01)
*F41A 19/15* (2006.01)

(52) U.S. Cl.
CPC ..... *F41A 3/66* (2013.01); *F41A 19/15* (2013.01)

(58) Field of Classification Search
CPC .. F41A 3/66; F41A 19/15; F41A 19/09; F41A 11/02; F41A 9/05
See application file for complete search history.

(56) References Cited

U.S. PATENT DOCUMENTS 4,463,654 A * 8/1984 Barnes ..... F41A 19/09 42/74
4,677,781 A * 7/1987 Lee ..... F41A 17/22 42/72
8,931,393 B1 * 1/2015 Vincent ..... F41A 17/46 89/27.3
9,677,846 B1 * 6/2017 Vankeuren, III ..... F41A 17/46
11,644,260 B1 * 5/2023 Douvier ..... F41A 11/02 42/75.01
12,085,352 B2 * 9/2024 Douvier ..... F41A 19/10
2013/0185975 A1 * 7/2013 Johnson ..... F41A 19/08 29/401.1
2014/0013640 A1 * 1/2014 Munson ..... F41A 17/38 42/6
2014/0075803 A1 * 3/2014 Muller ..... F41A 11/02 42/16
2014/0075812 A1 * 3/2014 Johnson ..... F41A 19/00 42/69.01
2015/0219421 A1 * 8/2015 Zamlinsky ..... F41A 3/66 42/71.01
2015/0267977 A1 * 9/2015 Boyarkin ..... F41A 17/38 89/191.01
2017/0115080 A1 * 4/2017 Boettner ..... F41A 3/66
2017/0131051 A1 * 5/2017 Albury ..... F41C 23/20
2018/0195822 A1 * 7/2018 Jonsson ..... F41A 3/66
2024/0077263 A1 * 3/2024 Douvier ..... F41A 19/09
2024/0077270 A1 * 3/2024 Popp ..... F41A 19/10
2025/0035394 A1 * 1/2025 Hamersley ..... F41A 11/02

* cited by examiner

*Primary Examiner* — Joshua E Freeman
(74) *Attorney, Agent, or Firm* — Muncy, Geissler, Olds & Lowe, P.C.

(57) ABSTRACT

A bullpup conversion kit and a gun including the same are provided, wherein bullpup conversion kit includes: a housing configured to be attached to the gun; a linkage member rotatably connected to the housing, and including a first end and a second end rotatable in opposing directions, the second end being configured to actuate a trigger of the gun; a trigger rotatably connected to the housing; an adaptor associated and movable with the trigger; and a first rod connected to the adaptor and the first end of the linkage member.

17 Claims, 7 Drawing Sheets

BULLPUP CONVERSION KIT AND GUN INCLUDING THE SAME

BACKGROUND OF THE INVENTION

Field of the Invention

The present invention relates to a bullpup conversion kit and gun including the same.

Description of the Prior Art

A gun, such as a rifle or the like, is widely used for combat, hunting, competition, entertainment, defense and security, etc.

The conventional gun generally has a trigger located between the magazine and the buttstock. For providing a sufficient distance from the trigger to the user, it requires a long buttstock, thus make the gun have a long length, not compact, heavy, and not easy and nimble to use.

In order to solve this problem, many companies on the market have provided bullpup conversion kits to convert traditional rifles into bullpup rifles, to move the trigger system and grip forward to the front of the original rifle magazine, thus being capable of shortening the length of the gun without changing the barrel of the original gun, and changing the gun's grip forward to a position with a better center of gravity.

However, a significant amount of force is needed to operate the forward-moving trigger linkage system of the conventional bullpup conversion kits so that it requires more effort from the finger and hand of the user. As a result, it can badly affect the aim of accuracy and precision.

Additionally, in the conventional bullpup conversion kit, it is necessary to develop and use a specific trigger kit, so the trigger group of the original gun must be discarded, thus being unable to be compatible with various types of guns and resulting in high costs. As such, it is very unfriendly and inconvenient to modification of the conventional guns.

The present invention is, therefore, arisen to obviate or at least mitigate the above-mentioned disadvantages.

SUMMARY OF THE INVENTION

The main object of the present invention is to provide a bullpup conversion kit and a gun including the same, which is simple, lightweight, ergonomic and compact, and easy and nimble to use, and provides good accuracy and precision at aiming, and which may allow the modification to the gun through the special trigger linkage mechanism design, the forward-moving trigger system of the bullpup conversion kit can be assembled to the original gun trigger for triggering without affecting the original gun structure. In addition, this trigger linkage system also includes a special mechanism so that the forwarded trigger of the bullpup conversion kit is compatible with trigger parts of common AR-15 or other guns on the market.

To achieve the above and other objects, the present invention provides a bullpup conversion kit, wherein bullpup conversion kit includes: a housing configured to be attached to the gun; a linkage member rotatably connected to the housing, and including a first end and a second end rotatable in opposing directions, the second end being configured to actuate a trigger of the gun; a trigger rotatably connected to the housing; an adaptor associated and movable with the trigger; and a first rod connected to the adaptor and the first end of the linkage member.

To achieve the above and other objects, the present invention further provides a gun including the bullpup conversion kit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
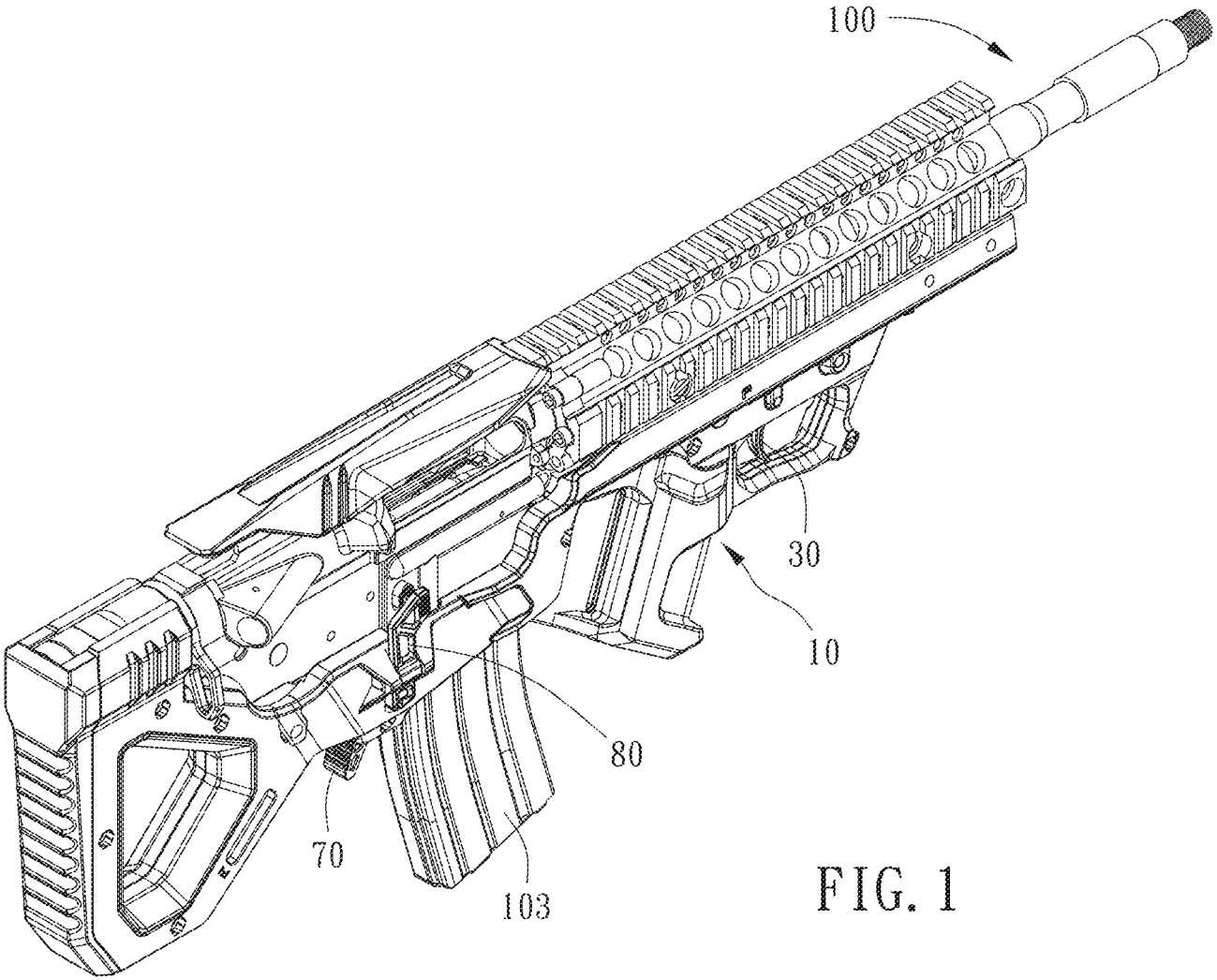
FIG. 1 is a stereogram of an exemplary embodiment of the present invention.
Figure 2:
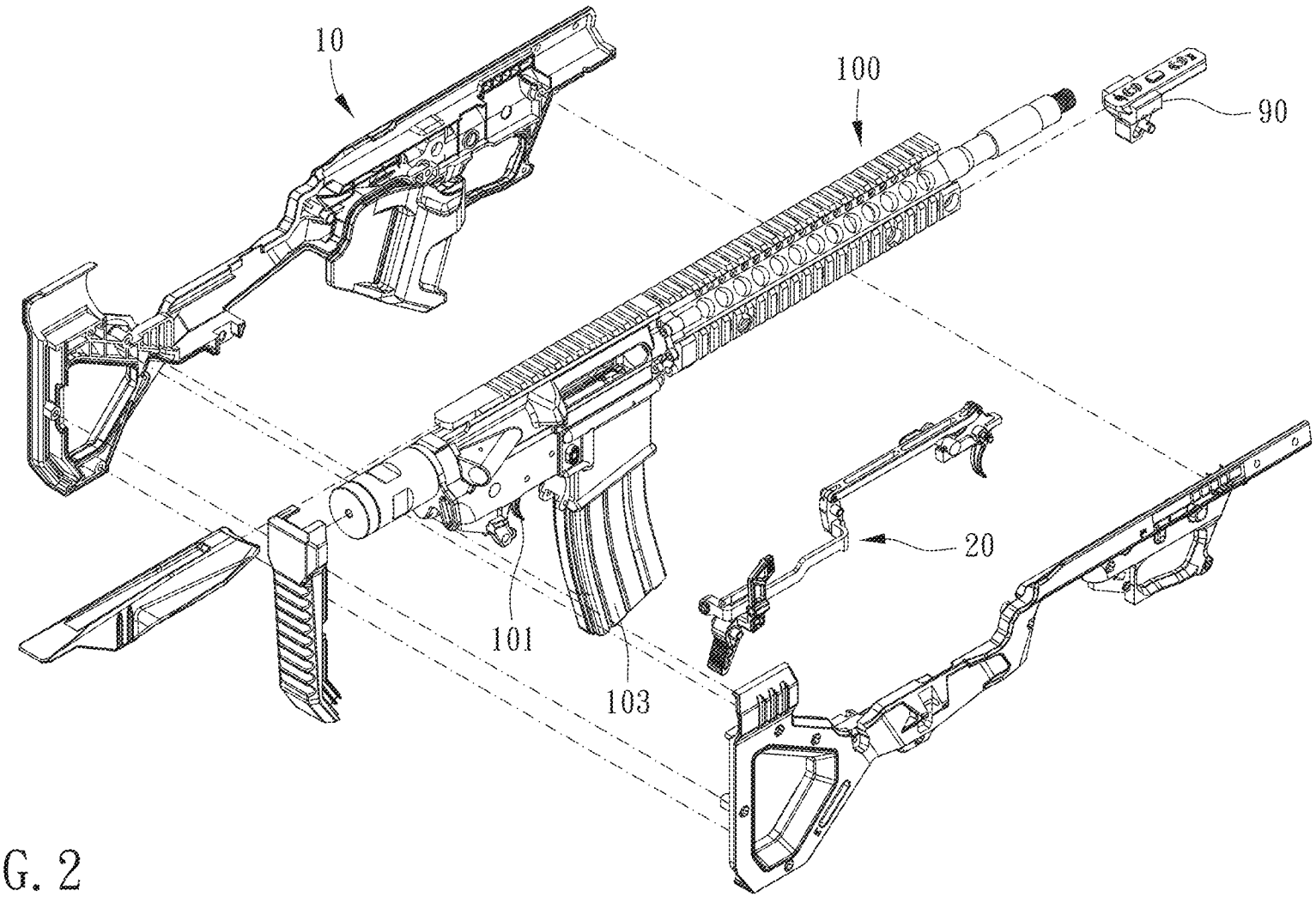
FIG. 2 is a breakdown drawing of an exemplary embodiment of the present invention.
Figure 3:
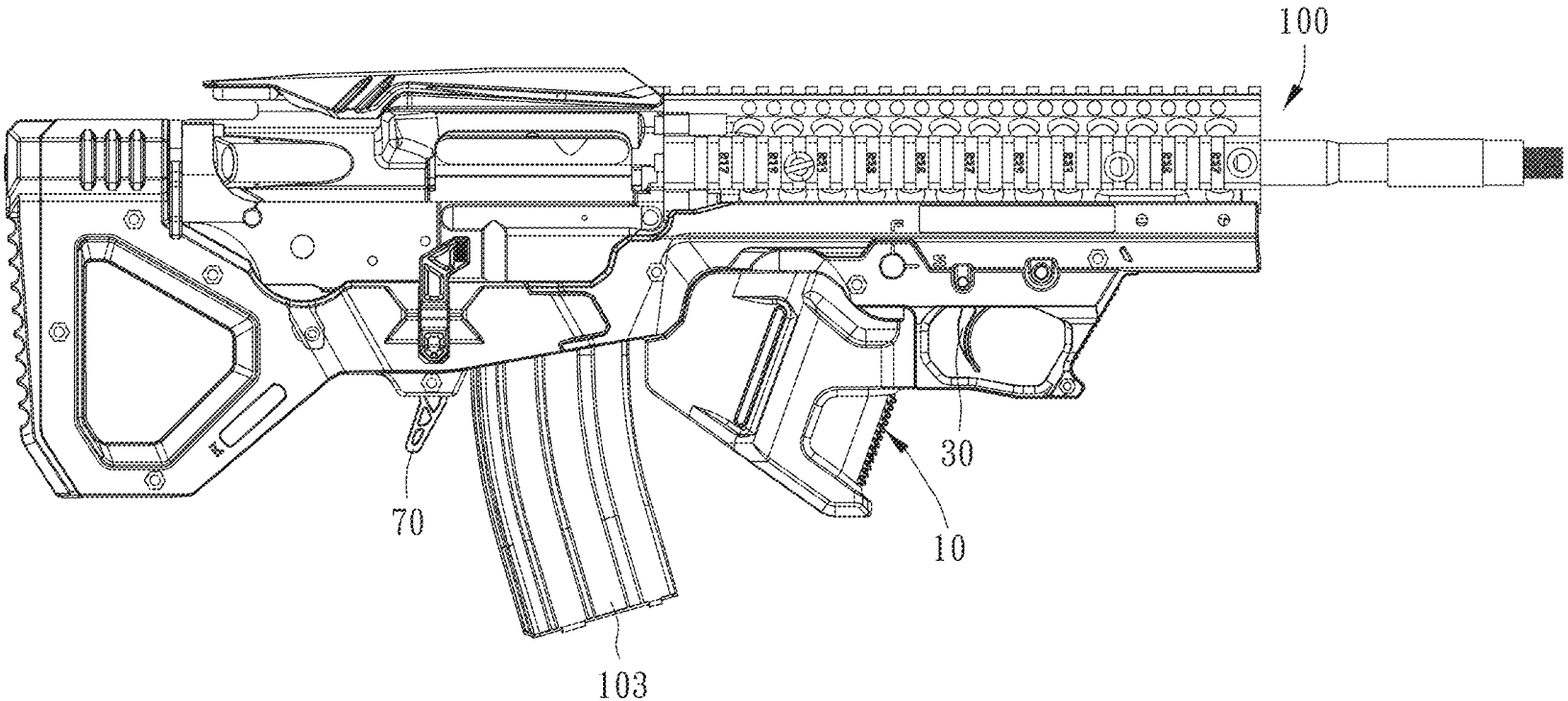
FIG. 3 is a side view of an exemplary embodiment of the present invention.
Figure 4:
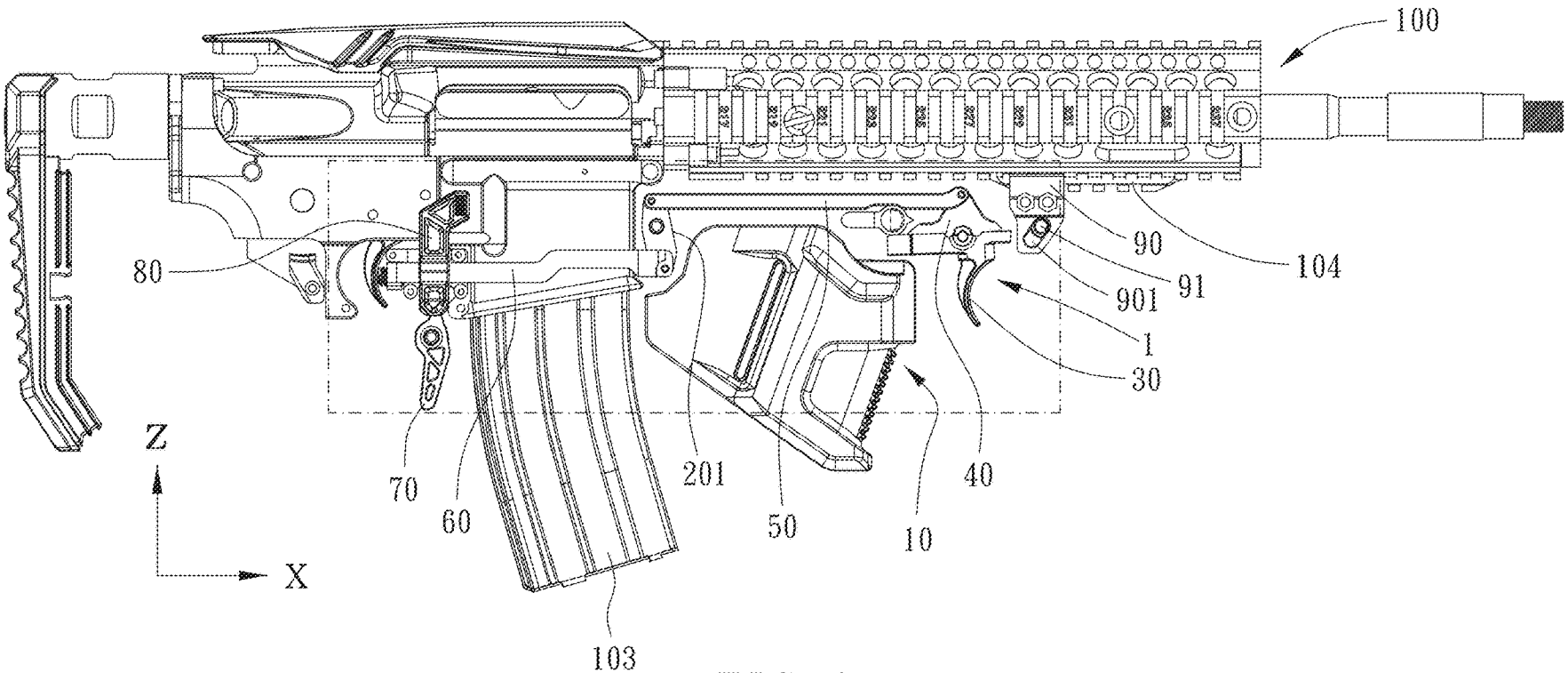
FIG. 4 is a partial breakdown side view of an exemplary embodiment of the present invention.
Figure 5:
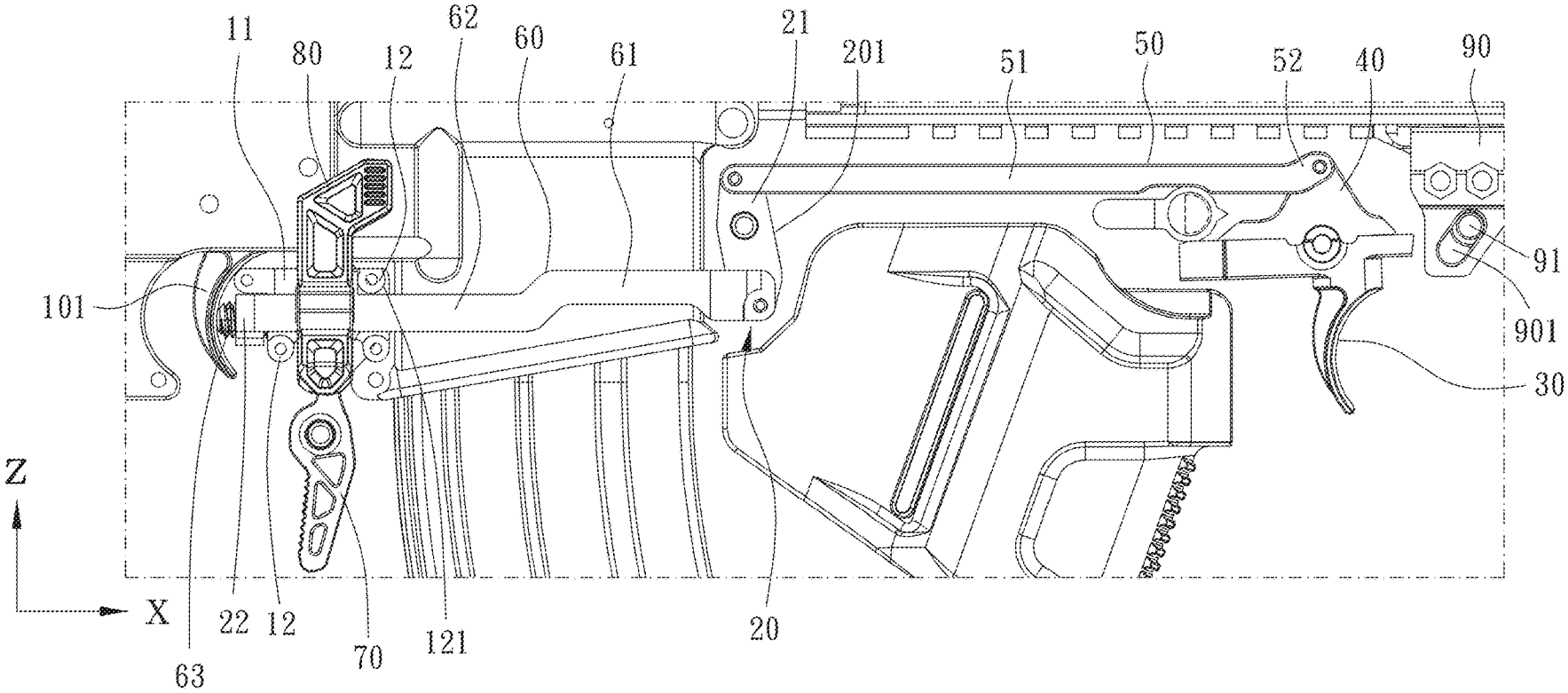
FIG. 5 is a partial enlargement of FIG. 3.
Figure 6:
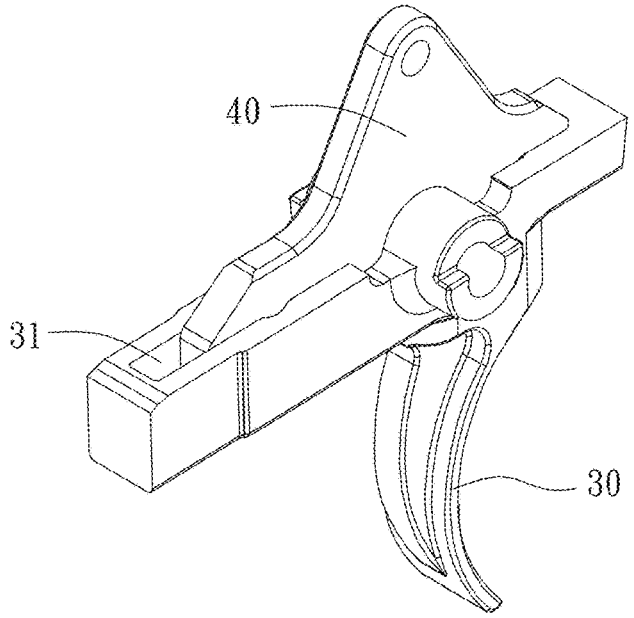
FIG. 6 is a drawing showing a trigger and an adaptor according to an exemplary embodiment of the present invention.
Figure 7:
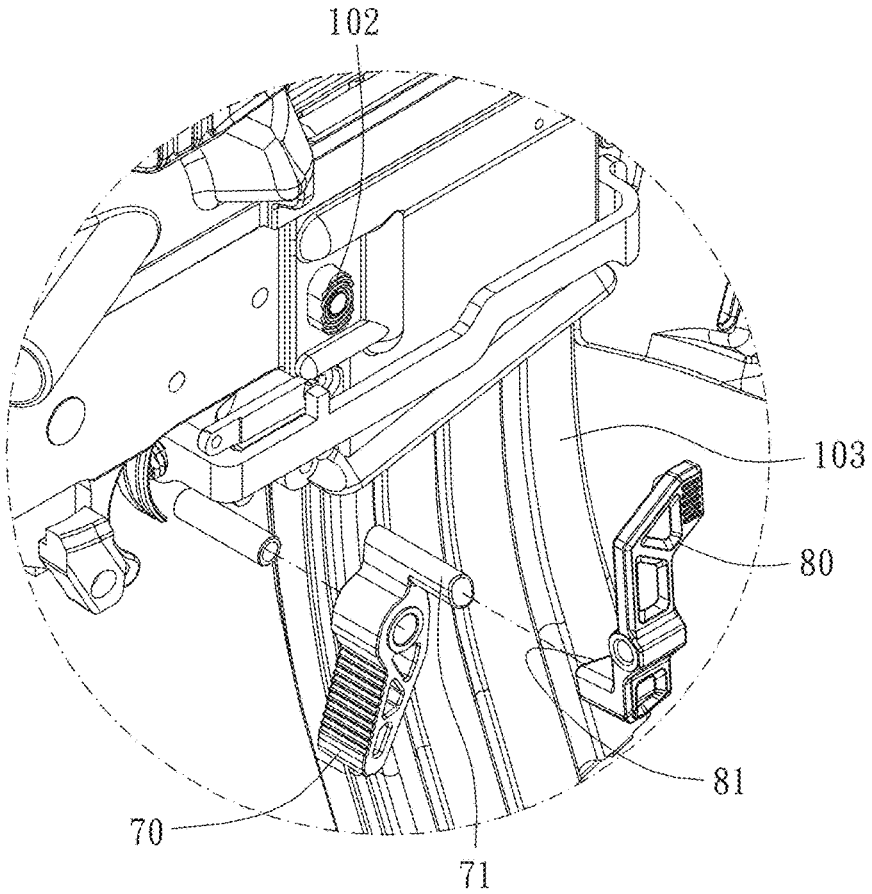
FIG. 7 is a partial breakdown drawing of an exemplary embodiment of the present invention.
Figure 8:
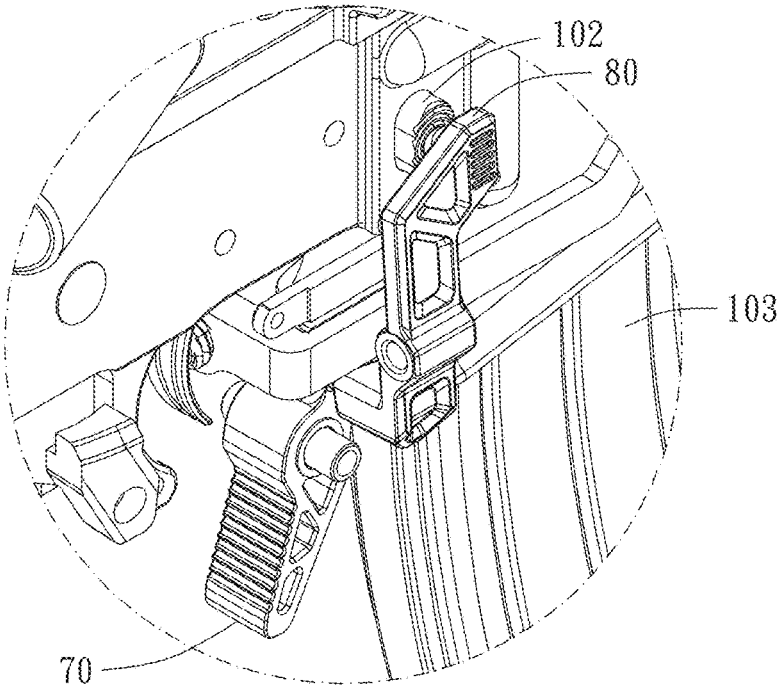
FIGS. 8 and 9 are drawings showing operation of a magazine release mechanism of an exemplary embodiment of the present invention.
Figure 9:
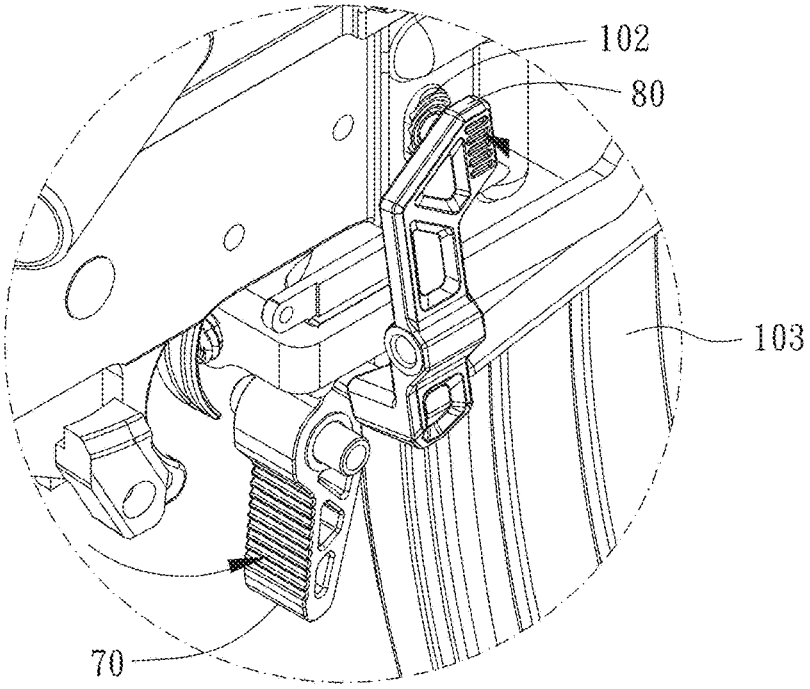

Please refer to FIGS. 1 to 9 for an exemplary embodiment of the present invention. A gun 100 with a bullpup conversion kit 1 assembled is provided. The bullpup conversion kit 1 of the present invention includes a housing 10, a linkage member 20, a trigger 30, an adaptor 40 and a first rod 50. A gun 100 including the bullpup conversion kit 1 is also provided, wherein the gun 100 may be a real gun or a toy gun. The gun 100 is such as AR 15 rifle, pistol or the like, and the bullpup conversion kit 1 is provided as a bullpup chassis for the gun 100.

The housing 10 is configured to be attached to the gun 100, which provides good performance of holding, gripping, stabilizing and protection. The linkage member 20 is rotatably connected to the housing 10, and includes a first end 21 and a second end 22 rotatable in opposing directions, and the second end 22 is configured to actuate a trigger 101 of the gun 100. The rotational movement of the linkage member 20 provides a large toque force for easily and rapidly actuating the trigger 101 of the gun 100. The trigger 30 is rotatably connected to the housing 10. The adaptor 40 is associated and movable with the trigger 30. The first rod 50 is connected to the adaptor 40 and the first end 21 of the linkage member 20. In this embodiment, the linkage member 20 further includes a rotatable member 201 rotatably connected to the housing 10, and a second rod 60 including the second end 22, the first rod 50 and the second rod 60 are connected to the rotatable member 201 and oppositely movable relative to the housing 10. The linkage member 20 may be a one-piece member. For example, the linkage member 20 may include only a rotatable member configured to actuate the trigger 101 of the gun 100 without a second rod. As such, the trigger 30 is located in a position more ahead such that the gun 100 can be provided with a shorter buttstock, the entire length of the gun 100 is short, the gun 100 is lightweight, ergonomic and compact, and the gun 100 can be easily and nimbly used, and it provides good accuracy and precision at aiming.

In this embodiment, the first end 21 and the second end 22 of the linkage member 20 are arranged on an x-z plane, which allows a compact arrangement of the bullpup conversion kit 1 and less interference with parts of the gun 100. The trigger 30 of the bullpup conversion kit 1 may be identical to the trigger 101 of the gun 100, so it is easy to obtain, has assembly high compatibility, and is conducive to precise actuation of the trigger 101 of the gun 100. The trigger 30 of the bullpup conversion kit 1 includes a slot 31, the adaptor 40 is partially received in the slot 31, and the adaptor 40 and the trigger 30 are pivoted to the housing 10 by a pin, so that the adaptor 40 is stably and precisely mounted and operated.

The first rod 50 includes a straight body section 51 connected to the rotatable member 201 and a distal section 52 connected to the adaptor 40, and the distal section 52 extends transversely from the straight body section 51 so that it provides an effective and large travel distance of the first rod 50 for driving the adaptor 40.

The second rod 60 is Z-shaped zigzagging on the x-z plane, which allows a compact arrangement of the bullpup conversion kit 1 and less interference with parts of the gun 100. The second rod 60 includes an upper bar section 61 connected to the rotatable member 201, and a lower bar section 62 configured to actuate the trigger 101 of the gun 100. The arrangement is quite in accordance with the structures of the gun 100. Specifically, the second rod 60 further includes an abutting member 63 adjustably disposed thereon, and the abutting member 63 is configured to actuate the trigger 101 of the gun 100. The abutting member 63 is, for example, axially adjustable so that it can be broadly compatible with various gun triggers.

Preferably, the housing 10 includes a guiding channel 11, and the second rod 60 is slidably disposed through the guiding channel 11, and thus it provides stable, precise and reliable actuation of the bullpup conversion kit 1. Specifically, the housing 10 further includes a plurality of guiding members 12 within the guiding channel 11 and arranged at opposing sides of the second rod 60. Each of the plurality of guiding members 12 preferably includes an arcuate surface 121 facing the second rod 60, which lowers the frictional resistance and smooths the movement of the second rod 60. In this embodiment, at least two of the plurality of guiding members 12 are axially offset relative to each other so that the second rod 60 can be precisely guided and stably supported.

In this embodiment, the bullpup conversion kit 1 further includes a first lever 70 rotatably connected to the housing 10 and a second lever 80 rotatably connected to the housing 10, wherein the first lever 70 and the second lever 80 are rotatable about axes transverse to each other (for example, the first lever 70 and the second lever 80 are rotatable about the axes perpendicular to each other), the first lever 70 includes a projection 71, the second lever 80 includes an inclined surface 81, and rotation of the first lever 70 operates to move the projection 71 to urge against the inclined surface 81 so that the second lever 80 rotates to press a magazine release button 102 to release a magazine 103 of the gun 100. Preferably, the first lever 70 is configured to be arranged behind and adjacent to the magazine 103 of the gun 100, and this facilitates the pressing on the magazine release button 102 without moving the hand to be located in an operation position much higher than the magazine 103 and beside a lateral side of the gun 100.

In this embodiment, the bullpup conversion kit 1 further including a connector 90 configured to be slidably mounted to a rail 104 of the gun 100, and the connector 90 is detachably connected to the housing 10 by using a fastener 91, which can stably secure the housing 10 to the gun 100. Preferably, the connector 90 includes an elongated slot 901 extending obliquely relative to a direction in which the rail 104 of the gun 100 extends. The elongated slot 901 provides a large combination margin so that the bullpup conversion kit 1 is widely compatible with various types of guns.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bullpup conversion kit including:

a housing configured to be attached to a gun;

a linkage member rotatably connected to the housing, and including a first end and a second end rotatable in opposing directions, the second end being configured to actuate a trigger of the gun;

a trigger rotatably connected to the housing;

an adaptor associated and movable with the trigger; and a first rod connected to the adaptor and the first end of the linkage member.

2. The bullpup conversion kit of claim 1, wherein the linkage member further includes a rotatable member rotatably connected to the housing, and a second rod including the second end, the first rod and the second rod are connected to the rotatable member and oppositely movable relative to the housing, and the first end and the second end of the linkage member are arranged on an x-z plane.

3. The bullpup conversion kit of claim 1, wherein the trigger of the bullpup conversion kit is identical to the trigger of the gun.

4. The bullpup conversion kit of claim 1, wherein the trigger of the bullpup conversion kit includes a slot, and the adaptor is partially received in the slot.

5. The bullpup conversion kit of claim 2, wherein the first rod includes a straight body section connected to the rotatable member and a distal section connected to the adaptor, and the distal section extends transversely from the straight body section.

6. The bullpup conversion kit of claim 2, wherein the second rod is Z-shaped zigzagging on an x-z plane.

7. The bullpup conversion kit of claim 2, wherein the second rod includes an upper bar section connected to the rotatable member, and a lower bar section configured to actuate the trigger of the gun.

8. The bullpup conversion kit of claim 2, wherein the second rod includes an abutting member adjustably disposed thereon, and the abutting member is configured to actuate the trigger of the gun.

9. The bullpup conversion kit of claim 2, wherein the housing includes a guiding channel, and the second rod is slidably disposed through the guiding channel.

10. The bullpup conversion kit of claim 9, wherein the housing further includes a plurality of guiding members within the guiding channel and arranged at opposing sides of the second rod.

11. The bullpup conversion kit of claim 10, wherein each of the plurality of guiding members includes an arcuate surface facing the second rod.

12. The bullpup conversion kit of claim 10, wherein at least two of the plurality of guiding members are axially offset relative to each other.

13. The bullpup conversion kit of claim 1, further including a first lever rotatably connected to the housing and a second lever rotatably connected to the housing, wherein the first lever and the second lever are rotatable about axes transverse to each other, the first lever includes a projection, the second lever includes an inclined surface, and rotation of the first lever operates to move the projection to urge against the inclined surface so that the second lever rotates to press and release a magazine release button.

14. The bullpup conversion kit of claim 13, wherein the first lever is configured to be arranged behind and adjacent to a magazine of the gun, and the first lever and the second lever are rotatable about the axes perpendicular to each other.

15. The bullpup conversion kit of claim 1, further including a connector configured to be slidably mounted to a rail of the gun, wherein the connector is detachably connected to the housing by using a fastener.

16. The bullpup conversion kit of claim 1, wherein the connector includes an elongated slot extending obliquely relative to a direction in which the rail of the gun extends.

17. A gun including the bullpup conversion kit of claim 1.

* * * * *